US009376250B2

(12) United States Patent
Spivey, Sr.

(10) Patent No.: US 9,376,250 B2
(45) Date of Patent: Jun. 28, 2016

(54) CARTON WITH RETENTION FEATURES

(71) Applicant: Graphic Packaging International, Inc., Atlanta, GA (US)

(72) Inventor: Raymond R. Spivey, Sr., Mableton, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/523,007

(22) Filed: Oct. 24, 2014

(65) Prior Publication Data

US 2015/0114874 A1 Apr. 30, 2015

Related U.S. Application Data

(60) Provisional application No. 61/961,882, filed on Oct. 25, 2013.

(51) Int. Cl.

| | |
|---|---|
| ***B65D 77/00*** | (2006.01) |
| ***B65D 71/18*** | (2006.01) |
| ***B65D 71/20*** | (2006.01) |
| ***B65D 71/24*** | (2006.01) |

(52) U.S. Cl.

CPC ..... *B65D 77/00* (2013.01); *B65D 71/18* (2013.01); *B65D 71/20* (2013.01); *B65D 71/24* (2013.01)

(58) Field of Classification Search

CPC ..... B65D 71/18; B65D 71/20; B65D 71/24; B65D 71/32; B65D 71/34; B65D 77/00; B65D 2571/00185; B65D 2571/00265; B65D 2571/00444; B65D 2571/00561; B65D 2571/0066; B65D 2571/00716

USPC ..... 206/140, 147–149, 152–156, 434

See application file for complete search history.

(56) References Cited

U.S. PATENT DOCUMENTS

| | | | |
|---|---|---|---|
| 1,527,399 | A | 2/1925 | Davidson |
| 1,925,102 | A | 9/1933 | Levkoff |
| 1,968,877 | A | 8/1934 | Cubberley |
| 2,005,924 | A | 6/1935 | Wilson |
| 2,067,749 | A | 1/1937 | Zimmerman et al. |
| 2,115,673 | A | 4/1938 | Stompe |

(Continued)

FOREIGN PATENT DOCUMENTS

| | | |
|---|---|---|
| AR | 78777 | 12/2008 |
| BE | 671 762 | 3/1966 |

(Continued)

OTHER PUBLICATIONS

International Search Report and Written Opinion for PCT/US2014/062133 dated Feb. 13, 2015.

*Primary Examiner* — Bryon Gehman

(74) *Attorney, Agent, or Firm* — Womble Carlyle Sandridge & Rice, LLP

(57) ABSTRACT

A carton for carrying a plurality of articles. The carton can comprise a plurality of panels at least partially extending around an interior of the carton. The plurality of panels can comprise a top panel, at least one side panel, and at least one bottom panel. At least one retention tab can be foldably connected to the at least one bottom panel. The at least one retention tab can be for engaging at least a portion of an article of the plurality of articles. At least one corner flap can be foldably connected to the at least one side panel. Each of the at least one retention tab and the at least one corner flap can be disposed adjacent to at least one corner opening in the carton.

34 Claims, 8 Drawing Sheets

(56) References Cited

U.S. PATENT DOCUMENTS

| | | | |
|---|---|---|---|
| 2,289,859 | A | 7/1942 | Arthur |
| 2,299,027 | A | 10/1942 | Novak |
| 2,331,038 | A | 10/1943 | Meller |
| 2,345,567 | A | 4/1944 | Arneson |
| 2,384,480 | A | 9/1945 | Lupton |
| 2,417,421 | A | 3/1947 | Koolnis |
| 2,522,950 | A | 9/1950 | Keith |
| 2,558,618 | A | 6/1951 | Lebold |
| 2,563,065 | A | 8/1951 | Price |
| 2,669,351 | A | 2/1954 | Carson et al. |
| 2,754,047 | A | 7/1956 | Schmidt et al. |
| 2,798,603 | A | 7/1957 | Grinspoon |
| 2,804,234 | A | 8/1957 | Lachance |
| 2,849,111 | A | 8/1958 | Fielding |
| RE24,667 | E | 7/1959 | Fielding |
| 2,922,561 | A | 1/1960 | Currivan |
| 2,928,541 | A | 3/1960 | Fielding |
| 2,929,497 | A | 3/1960 | De Million-Czarnecki |
| 2,950,041 | A | 8/1960 | Stone |
| 2,950,854 | A | 8/1960 | Ganz |
| 3,005,654 | A | 10/1961 | Stone et al. |
| 3,075,799 | A | 1/1963 | Weiss |
| 3,078,032 | A | 2/1963 | Robinson et al. |
| 3,128,010 | A | 4/1964 | Forrer |
| 3,133,634 | A | 5/1964 | Bozdar |
| 3,137,109 | A | 6/1964 | Rapata |
| 3,156,358 | A | 11/1964 | Randrup |
| 3,175,682 | A | 3/1965 | Forrer |
| 3,178,242 | A | 4/1965 | Ellis et al. |
| 3,228,582 | A | 1/1966 | Osberg |
| 3,237,762 | A | 3/1966 | Wood |
| 3,263,861 | A | 8/1966 | Carr |
| 3,265,283 | A | 8/1966 | Farquhar |
| 3,300,115 | A | 1/1967 | Schauer |
| 3,306,519 | A | 2/1967 | Wood |
| 3,332,594 | A | 7/1967 | De Capua |
| 3,339,723 | A | 9/1967 | Wood |
| 3,346,167 | A | 10/1967 | Schmidt |
| 3,355,012 | A | 11/1967 | Weiss |
| 3,356,279 | A | 12/1967 | Root |
| 3,363,928 | A | 1/1968 | Haufe et al. |
| 3,373,867 | A | 3/1968 | Wood |
| 3,386,570 | A | 6/1968 | Lock |
| 3,414,313 | A | 12/1968 | Schwarz |
| 3,503,498 | A | 3/1970 | Lawrence |
| 3,517,858 | A | 6/1970 | Farquhar |
| 3,528,697 | A | 9/1970 | Wood |
| 3,533,549 | A | 10/1970 | Gilchrist |
| 3,540,581 | A | 11/1970 | Koolnis |
| 3,593,849 | A | 7/1971 | Helms |
| 3,601,439 | A | 8/1971 | Poupitch |
| 3,627,121 | A | 12/1971 | Deasy |
| 3,635,452 | A | 1/1972 | Helms |
| 3,653,503 | A | 4/1972 | Arneson |
| 3,669,343 | A | 6/1972 | Howard |
| 3,670,950 | A | 6/1972 | Rossi |
| 3,701,416 | A | 10/1972 | Lawrence |
| 3,722,945 | A | 3/1973 | Wood |
| 3,744,704 | A | 7/1973 | Struble |
| 3,747,835 | A | 7/1973 | Graser |
| 3,752,305 | A | 8/1973 | Heyne |
| 3,767,042 | A | 10/1973 | Ganz |
| 3,820,657 | A | 6/1974 | Klygis et al. |
| 3,884,353 | A | 5/1975 | Forte |
| 3,897,873 | A | 8/1975 | Graser |
| 3,942,631 | A | 3/1976 | Sutherland et al. |
| 3,963,121 | A | 6/1976 | Kipp |
| 4,010,593 | A | 3/1977 | Graham |
| 4,029,204 | A | 6/1977 | Manizza |
| 4,096,985 | A | 6/1978 | Wood |
| 4,101,069 | A | 7/1978 | Wood |
| 4,146,168 | A | 3/1979 | Hartline |
| 4,155,449 | A | 5/1979 | Bryne |
| 4,192,540 | A | 3/1980 | Oliff |
| 4,202,446 | A | 5/1980 | Sutherland |
| 4,214,660 | A | 7/1980 | Hunt, Jr. |
| 4,216,861 | A | 8/1980 | Oliff |
| 4,222,485 | A | 9/1980 | Focke |
| 4,256,226 | A | 3/1981 | Stone |
| 4,272,010 | A | 6/1981 | Capo |
| 4,304,329 | A | 12/1981 | Graser |
| 4,305,500 | A | 12/1981 | Jaeschke |
| 4,318,474 | A | 3/1982 | Hasegawa |
| 4,326,628 | A | 4/1982 | Wood |
| 4,328,893 | A | 5/1982 | Oliff et al. |
| 4,336,898 | A | 6/1982 | Joyce |
| 4,364,509 | A | 12/1982 | Holley, Jr. et al. |
| 4,372,599 | A | 2/1983 | Kiedaisch et al. |
| 4,375,258 | A | 3/1983 | Crayne et al. |
| 4,376,509 | A | 3/1983 | Schaffer |
| 4,378,877 | A | 4/1983 | Botterman et al. |
| 4,378,879 | A | 4/1983 | Killy |
| 4,382,505 | A | 5/1983 | Sutherland et al. |
| 4,394,903 | A | 7/1983 | Bakx |
| 4,396,143 | A | 8/1983 | Killy |
| 4,398,636 | A | 8/1983 | Baxter |
| 4,417,655 | A | 11/1983 | Forbes, Jr. |
| 4,417,661 | A | 11/1983 | Roccaforte |
| 4,421,232 | A | 12/1983 | Konaka |
| 4,424,901 | A | 1/1984 | Lanier |
| 4,440,340 | A | 4/1984 | Bakx |
| 4,533,047 | A | 8/1985 | Calvert |
| 4,566,591 | A | 1/1986 | Turtschan et al. |
| 4,566,593 | A | 1/1986 | Muller |
| 4,577,762 | A | 3/1986 | Kuchenbecker |
| 4,601,390 | A | 7/1986 | Rosenthal et al. |
| 4,605,128 | A | 8/1986 | Rieke |
| 4,658,984 | A | 4/1987 | Brunner |
| 4,703,847 | A | 11/1987 | Oliff |
| 4,708,284 | A | 11/1987 | Sutherland et al. |
| 4,747,487 | A | 5/1988 | Wood |
| 4,784,266 | A | 11/1988 | Chaussadas |
| 4,804,089 | A | 2/1989 | Wilson |
| 4,807,751 | A | 2/1989 | Klygis et al. |
| 4,817,866 | A | 4/1989 | Wonnacott |
| 4,860,943 | A | 8/1989 | Cooper |
| 4,875,585 | A | 10/1989 | Kadleck et al. |
| 4,890,440 | A | 1/1990 | Romagnoli |
| 4,901,849 | A | 2/1990 | Wilson |
| 4,919,266 | A | 4/1990 | McIntosh, Jr. et al. |
| 4,949,845 | A | 8/1990 | Dixon |
| 4,966,324 | A | 10/1990 | Steel |
| 4,972,991 | A | 11/1990 | Schuster |
| 4,974,771 | A | 12/1990 | Lavery |
| 5,000,313 | A | 3/1991 | Oliff |
| 5,042,660 | A | 8/1991 | Carver |
| 5,060,792 | A | 10/1991 | Oliff |
| 5,101,642 | A | 4/1992 | Alexandrov |
| 5,103,971 | A | 4/1992 | Schuster |
| 5,131,588 | A | 7/1992 | Oliff |
| 5,137,211 | A | 8/1992 | Summer et al. |
| 5,139,147 | A | 8/1992 | Sutherland |
| 5,163,548 | A | 11/1992 | Domansky |
| 5,167,325 | A | 12/1992 | Skora |
| 5,180,100 | A | 1/1993 | Shimizu |
| 5,188,225 | A | 2/1993 | Jorba |
| 5,195,676 | A | 3/1993 | LeBras |
| 5,201,412 | A | 4/1993 | Schuster et al. |
| 5,219,229 | A | 6/1993 | Sengewald |
| 5,234,103 | A | 8/1993 | Schuster |
| 5,246,112 | A | 9/1993 | Stout et al. |
| 5,246,113 | A | 9/1993 | Schuster |
| 5,249,681 | A | 10/1993 | Miller |
| 5,267,644 | A | 12/1993 | Tsao |
| 5,297,673 | A | 3/1994 | Sutherland |
| 5,310,050 | A | 5/1994 | Sutherland |
| 5,310,051 | A | 5/1994 | Sutherland |
| 5,318,178 | A | 6/1994 | Davies et al. |
| 5,323,895 | A | 6/1994 | Sutherland et al. |
| 5,328,024 | A | 7/1994 | Sutherland |
| 5,351,815 | A | 10/1994 | Fogle et al. |
| 5,351,816 | A | 10/1994 | Sutherland et al. |
| 5,351,817 | A | 10/1994 | Sutherland |
| 5,351,878 | A | 10/1994 | Cooper |

(56) References Cited

U.S. PATENT DOCUMENTS 5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,421,458 A 6/1995 Campbell
5,425,474 A 6/1995 Dalea et al.
5,437,363 A 8/1995 Gungner
5,443,153 A 8/1995 Sutherland
5,443,203 A 8/1995 Sutherland
5,445,262 A 8/1995 Sutherland
5,452,799 A 9/1995 Sutherland
5,472,090 A 12/1995 Sutherland
5,472,138 A 12/1995 Ingram
5,476,170 A 12/1995 Weber
5,482,185 A 1/1996 McNaughton
5,484,059 A 1/1996 Sutherland
5,485,915 A 1/1996 Harris
5,503,267 A 4/1996 Sutherland
5,505,372 A 4/1996 Edson et al.
5,520,283 A 5/1996 Sutherland
5,524,756 A 6/1996 Sutherland
5,542,536 A 8/1996 Sutherland
5,549,197 A 8/1996 Sutherland
5,551,566 A 9/1996 Sutherland
5,553,705 A 9/1996 Bakx
5,558,212 A 9/1996 Sutherland
5,558,213 A 9/1996 Sutherland
5,577,612 A 11/1996 Chesson et al.
5,593,027 A 1/1997 Sutherland
5,595,291 A 1/1997 Negelen
5,597,071 A 1/1997 Sutherland
5,597,114 A 1/1997 Kramedjian et al.
5,609,251 A 3/1997 Harris
5,620,094 A 4/1997 Naumann
5,622,309 A 4/1997 Matsuda et al.
5,664,401 A 9/1997 Portrait et al.
5,664,683 A 9/1997 Brody
5,667,070 A 9/1997 Miret
5,682,995 A 11/1997 Sutherland
5,687,838 A 11/1997 Bakx
5,690,213 A 11/1997 Matsumura
5,690,230 A 11/1997 Griffith
5,692,614 A 12/1997 Harris
5,704,542 A 1/1998 Harrelson
5,706,936 A 1/1998 Bernstein
5,711,419 A 1/1998 Beales et al.
5,746,310 A 5/1998 Slomski
5,778,630 A 7/1998 Portrait et al.
5,782,343 A 7/1998 Harrelson
5,791,463 A 8/1998 Negelen
5,794,778 A 8/1998 Harris
5,816,391 A 10/1998 Harris
5,820,185 A 10/1998 Gomes
5,826,783 A 10/1998 Stout
5,853,088 A 12/1998 Saulas et al.
5,855,318 A 1/1999 Baxter
5,875,961 A 3/1999 Stone et al.
5,881,884 A 3/1999 Podosek
5,921,392 A 7/1999 Davis
5,921,398 A 7/1999 Carroll
5,924,559 A 7/1999 Carrel et al.
5,927,498 A 7/1999 Saam
5,931,300 A 8/1999 Sutherland
5,937,620 A 8/1999 Chalendar
5,941,453 A 8/1999 Oliff
5,943,847 A 8/1999 Chalendar
5,947,367 A 9/1999 Miller et al.
5,960,945 A 10/1999 Sutherland
5,975,286 A 11/1999 Oliff
6,019,220 A 2/2000 Sutherland
6,021,898 A 2/2000 Sutherland
6,021,899 A 2/2000 Sutherland
6,039,181 A 3/2000 Whiteside
6,050,402 A 4/2000 Walter
6,059,099 A 5/2000 Galbierz
6,109,438 A 8/2000 Sutherland
6,155,480 A 12/2000 Botsford et al.
6,158,586 A 12/2000 Muller
6,176,419 B1 1/2001 Holley, Jr.
6,223,892 B1 5/2001 Bakx
6,227,367 B1 5/2001 Harrelson et al.
6,241,083 B1 6/2001 Harrelson
6,283,293 B1 9/2001 Lingamfelter
6,289,651 B1 9/2001 Le Bras
6,315,111 B1 11/2001 Sutherland
6,315,123 B1 11/2001 Ikeda
6,378,697 B1 * 4/2002 Sutherland ..... B65D 71/16 206/140
6,378,765 B1 4/2002 Sutherland
6,394,272 B1 5/2002 Domansky
6,409,077 B1 6/2002 Telesca et al.
D459,927 S 7/2002 Flowers et al.
6,478,219 B1 11/2002 Holley, Jr.
6,484,903 B2 11/2002 Spivey et al.
6,488,322 B2 12/2002 Bakx
6,550,615 B2 4/2003 Lingamfelter
6,550,616 B2 4/2003 Le Bras
6,557,699 B1 5/2003 Focke et al.
6,578,736 B2 6/2003 Spivey
6,604,677 B1 8/2003 Sutherland et al.
6,669,083 B2 12/2003 Bates
6,695,137 B2 2/2004 Jones et al.
6,715,639 B2 4/2004 Spivey
6,752,262 B1 6/2004 Boriani et al.
6,789,673 B2 9/2004 Lingamfelter
6,811,525 B2 11/2004 Culpepper
6,866,185 B2 3/2005 Harrelson
6,866,186 B2 3/2005 Fogle et al.
6,866,188 B2 3/2005 Harrelson
6,896,130 B2 5/2005 Theelen
6,902,104 B2 6/2005 Holley, Jr. et al.
6,918,487 B2 7/2005 Harrelson
6,929,172 B2 8/2005 Bates et al.
6,945,450 B2 9/2005 Rusnock
6,948,651 B2 9/2005 Ikeda
6,968,992 B2 11/2005 Schuster
6,969,172 B2 11/2005 Actis-Datta
6,974,072 B2 12/2005 Harrelson
6,981,631 B2 1/2006 Fogle et al.
6,988,617 B2 1/2006 Gomes et al.
6,991,107 B2 1/2006 Harrelson
6,997,316 B2 2/2006 Sutherland
7,000,803 B2 2/2006 Miller
7,007,800 B2 3/2006 Le Bras
7,011,209 B2 3/2006 Sutherland et al.
7,025,197 B2 4/2006 Sutherland
7,083,046 B2 8/2006 Bakx
7,104,435 B2 9/2006 Holley, Jr.
7,134,593 B2 11/2006 Harrelson
7,159,759 B2 1/2007 Sutherland
7,163,103 B2 1/2007 Bakx et al.
7,168,558 B2 1/2007 Harrelson
7,175,020 B2 2/2007 Sutherland et al.
7,225,930 B2 6/2007 Ford et al.
7,240,789 B2 7/2007 Sutherland
7,264,114 B2 9/2007 Daniel
7,374,038 B2 5/2008 Smalley
7,427,010 B2 9/2008 Sutherland
7,448,492 B2 11/2008 Sutherland
7,644,817 B2 1/2010 Sutherland
7,677,387 B2 3/2010 Brand et al.
7,690,507 B2 4/2010 Sutherland
7,721,878 B2 5/2010 Requena
7,762,395 B2 7/2010 Sutherland et al.
7,762,397 B2 7/2010 Coltri-Johnson et al.
7,766,181 B2 8/2010 Fogle et al.
7,789,231 B2 9/2010 Requena
7,823,721 B2 11/2010 Sutherland
7,913,844 B2 3/2011 Spivey, Sr.
8,056,709 B2 11/2011 Sutherland
8,061,519 B2 11/2011 Taglione
8,096,413 B2 1/2012 De Paula
8,162,135 B2 4/2012 Oliveira

(56) References Cited

U.S. PATENT DOCUMENTS

| | | | | |
|---|---|---|---|---|
| 8,424,677 | B2 | 4/2013 | Spivey, Sr. et al. | |
| 8,955,674 | B2 | 2/2015 | Spivey, Sr. et al. | |
| 8,997,986 | B2 * | 4/2015 | Spivey, Sr. ..... | B65D 71/18 206/147 |
| 2002/0029991 | A1 | 3/2002 | Lingamfelter | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2002/0195371 | A1 | 12/2002 | Brown | |
| 2003/0000182 | A1 | 1/2003 | Portrait et al. | |
| 2003/0080004 | A1 | 5/2003 | Olsen et al. | |
| 2003/0132130 | A1 | 7/2003 | Le Bras | |
| 2003/0141313 | A1 | 7/2003 | Bates | |
| 2003/0150759 | A1 | 8/2003 | White, Jr. | |
| 2003/0192907 | A1 | 10/2003 | Bates | |
| 2003/0213705 | A1 | 11/2003 | Woog | |
| 2004/0000582 | A1 | 1/2004 | Sutherland | |
| 2004/0011674 | A1 | 1/2004 | Theelen | |
| 2004/0060972 | A1 | 4/2004 | Harrelson | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188277 | A1 | 9/2004 | Auclair | |
| 2004/0188300 | A1 | 9/2004 | Sutherland | |
| 2004/0188301 | A1 | 9/2004 | Gomes | |
| 2004/0226833 | A1 | 11/2004 | Daniel | |
| 2004/0243277 | A1 | 12/2004 | Bonnain et al. | |
| 2004/0254666 | A1 | 12/2004 | Bonnain et al. | |
| 2005/0001020 | A1 | 1/2005 | Garnier | |
| 2005/0023170 | A1 | 2/2005 | Lingamfelter | |
| 2005/0092820 | A1 | 5/2005 | Chekroune | |
| 2005/0103650 | A1 | 5/2005 | Auclair et al. | |
| 2005/0126947 | A1 | 6/2005 | Holley, Jr. | |
| 2005/0127151 | A1 | 6/2005 | Johnson | |
| 2005/0167290 | A1 | 8/2005 | Sutherland | |
| 2005/0178791 | A1 | 8/2005 | Miller | |
| 2005/0189405 | A1 | 9/2005 | Gomes et al. | |
| 2005/0194430 | A1 | 9/2005 | Auclair et al. | |
| 2005/0224565 | A1 | 10/2005 | Holley | |
| 2006/0054522 | A1 | 3/2006 | Kline et al. | |
| 2006/0091193 | A1 | 5/2006 | DeBusk | |
| 2006/0118606 | A1 | 6/2006 | Holley, Jr. et al. | |
| 2006/0131370 | A1 | 6/2006 | Bates | |
| 2006/0157545 | A1 | 7/2006 | Auclair | |
| 2006/0175386 | A1 | 8/2006 | Holley, Jr. | |
| 2006/0191811 | A1 | 8/2006 | Fogle et al. | |
| 2006/0255108 | A1 | 11/2006 | Shmagin | |
| 2008/0121536 | A1 | 5/2008 | Miret | |
| 2008/0135423 | A1 | 6/2008 | Oliveira | |
| 2009/0101526 | A1 | 4/2009 | Sutherland et al. | |
| 2009/0127147 | A1 | 5/2009 | Sutherland | |
| 2010/0072267 | A1 | 3/2010 | May et al. | |
| 2010/0264043 | A1 | 10/2010 | De Paula | |
| 2011/0000799 | A1 | 1/2011 | Gonzalez | |
| 2011/0284623 | A1 | 11/2011 | Jones et al. | |
| 2012/0080328 | A1 | 4/2012 | De Paula | |
| 2012/0104080 | A1 | 5/2012 | Spivey, Sr. et al. | |
| 2012/0138489 | A1 | 6/2012 | Holley, Jr. | |
| 2012/0285854 | A1 | 11/2012 | Spivey, Sr. | |
| 2012/0285855 | A1 | 11/2012 | Spivey | |

FOREIGN PATENT DOCUMENTS

| | | |
|---|---|---|
| CA | 873185 | 6/1971 |
| DE | 91 04 905.9 | 6/1991 |
| DE | 92 03 858.1 | 5/1992 |
| DE | 202 13 450 | 11/2002 |
| EP | 0 459 658 | 12/1991 |
| EP | 0 509 749 | 10/1992 |
| EP | 0 066 029 | 12/1992 |
| EP | 0 520 411 | 12/1992 |
| EP | 0 636 554 | 2/1995 |
| EP | 0 806 372 | 6/1997 |
| EP | 1 348 638 | 10/2003 |
| EP | 1 384 679 | 1/2004 |
| EP | 2 251 276 | 8/2012 |
| FR | 2 549 010 | 1/1985 |
| FR | 2 698 074 | 5/1994 |
| GB | 2 264 101 | 8/1993 |
| GB | 2 279 065 | 12/1994 |
| JP | 41-18199 | 10/1965 |
| JP | 5-112373 | 5/1993 |
| JP | 2003-146359 | 5/2003 |
| WO | WO 93/25439 | 12/1993 |
| WO | WO 96/29260 | 9/1996 |
| WO | WO 97/27124 | 7/1997 |
| WO | WO 98/49071 | 11/1998 |
| WO | WO 99/64301 | 12/1999 |
| WO | WO 00/03937 | 1/2000 |
| WO | WO 02/47990 | 6/2002 |
| WO | WO 02/102208 | 12/2002 |
| WO | WO 03/008292 | 1/2003 |
| WO | WO 2004/043790 | 5/2004 |
| WO | WO 2004/087507 | 10/2004 |
| WO | WO 2005/051781 | 6/2005 |
| WO | WO 2005/092735 | 10/2005 |
| WO | WO 2005/042370 | 12/2005 |
| WO | WO 2006/050210 | 5/2006 |
| WO | WO 2006/050316 | 5/2006 |
| WO | WO 2007/089844 | 8/2007 |
| WO | WO 2007/126977 | 11/2007 |
| WO | WO 2009/015320 | 1/2009 |

* cited by examiner

CARTON WITH RETENTION FEATURES

CROSS-REFERENCE TO RELATED APPLICATIONS

This application claims the benefit of U.S. Provisional Patent Application No. 61/961,882, filed Oct. 25, 2013.

INCORPORATION BY REFERENCE

The disclosure of U.S. Provisional Patent Application No. 61/961,882, which was filed on Oct. 25, 2013, is hereby incorporated by reference for all purposes as if presented herein in its entirety.

BACKGROUND OF THE DISCLOSURE

The present disclosure generally relates to carriers and cartons for holding and dispensing product containers or other types of articles.

SUMMARY OF THE DISCLOSURE

In general, one aspect of the disclosure is directed to a carton for carrying a plurality of articles. The carton comprises at least one retention tab for engaging at least a portion of an article of the plurality of articles and at least one corner flap. Each of the at least one retention tab and the at least one corner flap is disposed adjacent at least one corner opening in the carton.

In another aspect, the disclosure is generally directed to a carton for carrying a plurality of articles. The carton can comprise a plurality of panels at least partially extending around an interior of the carton. The plurality of panels can comprise a top panel, at least one side panel, and at least one bottom panel. At least one retention tab can be foldably connected to the at least one bottom panel. The at least one retention tab can be for engaging at least a portion of an article of the plurality of articles. At least one corner flap can be foldably connected to the at least one side panel. Each of the at least one retention tab and the at least one corner flap can be disposed adjacent to at least one corner opening in the carton.

In another aspect, the disclosure is generally directed to a blank for forming a carton for holding a plurality of articles. The blank can comprise a plurality of panels comprising a top panel, at least one side panel, and at least one bottom panel. At least one retention tab can be foldably connected to the at least one bottom panel. At least one corner flap can be foldably connected to the at least one side panel. The at least one retention tab can be at least partially separable from the at least one corner flap along at least one cut line for forming at least one corner opening in the carton formed from the blank.

In another aspect, the disclosure is directed to a method of forming a carton for holding a plurality of articles. The method can comprise obtaining a blank comprising a plurality of panels comprising a top panel, at least one side panel, and at least one bottom panel, at least one retention tab foldably connected to the at least one bottom panel, and at least one corner flap foldably connected to the at least one side panel. The at least one retention tab can be at least partially separable from the at least one corner flap along at least one cut line. The method further can comprise forming an interior of the carton at least partially defined by the plurality of panels. The forming the interior can comprise folding the at least one bottom panel with respect to the at least one side panel. The method also can comprise at least partially engaging the at least one retention tab with a bottom portion of an article of the plurality of articles. The engaging the at least one retention tab can at least partially form a corner opening in the carton.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons or carriers that contain articles such as containers, bottles, cans, etc. The articles can be used for personal care or food products, for example. The articles can be made from materials suitable in composition for packaging the product, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes product containers (e.g., plastic personal care containers) as disposed within the carrier embodiments. In this specification, the terms "inner," "interior," "outer," "exterior," "lower," "bottom," "upper," and "top" indicate orientations determined in relation to fully erected and upright cartons.

Figure 1:
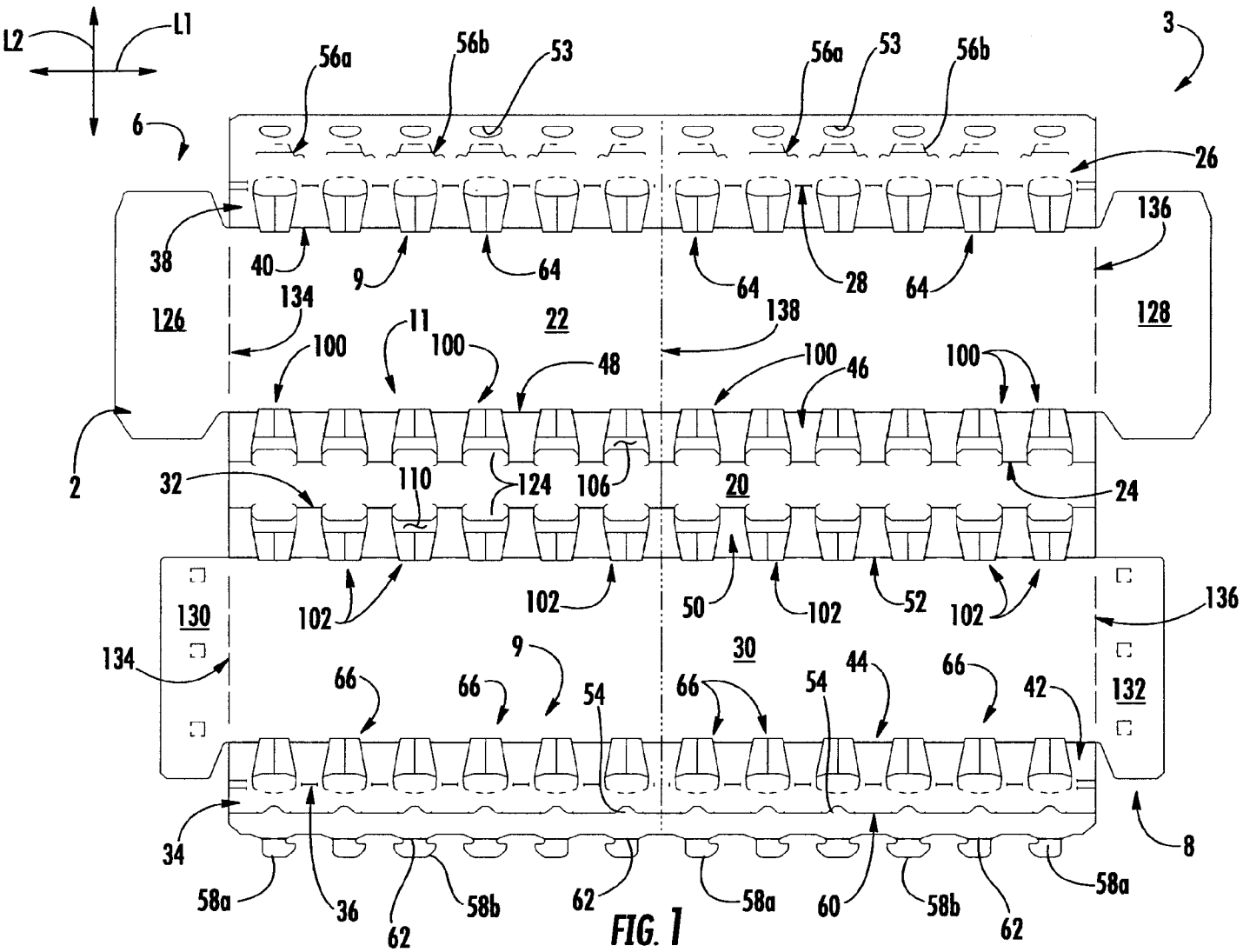
FIG. 1 is a plan view of an exterior surface of a blank used to form a carton according to an exemplary embodiment of the disclosure.

FIG. 1 is a plan view of an exterior surface 2 of a blank 3, used to form a carton 5 (FIG. 7) according to an exemplary embodiment of the disclosure. The carton 5 can be used to house a plurality of articles such as containers C (FIG. 4-7). In the illustrated embodiment, the containers C are product containers (e.g., deodorant containers, and/or other suitable articles) and the carton 5 is sized to house 12 containers C in a single layer in a 1×12 arrangement, but it is understood that the carton 5 may be sized and shaped to hold containers C of a different or same quantity in more than one layer and/or in different row/column arrangements (e.g., 1×6, 2×3, 2×6, 2×4, 2×2, 2×6×2, 2×4×2, 2×9, etc.). In the illustrated embodiment, the carton 5 can include bottom retention features 9 for engaging the bottom portions B of the containers C and top retention features 11 for engaging the top portions (not shown) of the containers C.

In the illustrated embodiment, the blank 3 has ends 6, 8 that can form at least partially closed ends (not shown) in the carton 5, and the carton can wrap around the containers C (e.g., the carton 5 may be referred to as a wrap-around carton). The carton 5 could be otherwise shaped and arranged such the ends 6, 8 are generally open or fully closed such as by end flaps or other closing mechanisms.

The blank 3 has a longitudinal axis L1 and a lateral axis L2. In the illustrated embodiment, the blank 3 comprises a top panel 20 foldably connected to a first side panel 22 at a first longitudinal fold line 24, a first bottom panel 26 foldably connected to the first side panel 22 at a second longitudinal fold line 28, a second side panel 30 foldably connected to the top panel 20 at a third longitudinal fold line 32, and a second bottom panel 34 foldably connected to the second side panel 30 at a fourth longitudinal fold line 36. In the illustrated embodiment, the first side panel 22 includes a first bottom corner panel 38 defined by longitudinal fold lines 28 and 40. The second side panel 30 includes a second bottom corner panel 42 defined by longitudinal fold lines 36 and 44. Additionally, the first side panel 22 can include a first top corner panel 46 defined by longitudinal fold lines 24 and 48, and the second side panel 30 can include a second top corner panel 50 defined by longitudinal fold lines 32 and 52.

The first bottom panel 26, which is the inner bottom panel flap in the assembled carton 5, includes cutouts forming primary female locking edges 53 that are shaped and positioned to engage primary male locking tab projections 54 on the second bottom panel 34. The first bottom panel 26 also includes asymmetric slits 56*a* and generally symmetric slits 56*b* shaped and positioned to receive respective outer secondary locking tab projections 58*a*, 58*b* of the second bottom panel 34. The secondary locking tab projections 58*a* can be asymmetric to correspond with the asymmetric slits 56*a*, and the secondary locking tab projections 58*b* can be generally symmetric to correspond with the symmetric slits 56*b*. Accordingly, the asymmetric secondary locking tabs 58*a* can have a single prong 59*a* (FIG. 2B), and the asymmetric slits 56*a* can have a single side cut 57*a* (FIG. 2A) for receiving the single prong 59*a* of a respective asymmetric secondary locking tab 58*a*. The symmetric secondary locking tabs 58*b* can have two prongs 59*b* (FIG. 2B), and the symmetric slits 56*b* can have two side cuts 57*b* (FIG. 2A) for receiving the respective prongs 59*b* of a respective symmetric secondary locking tab 58*b*.

Figure 2A:
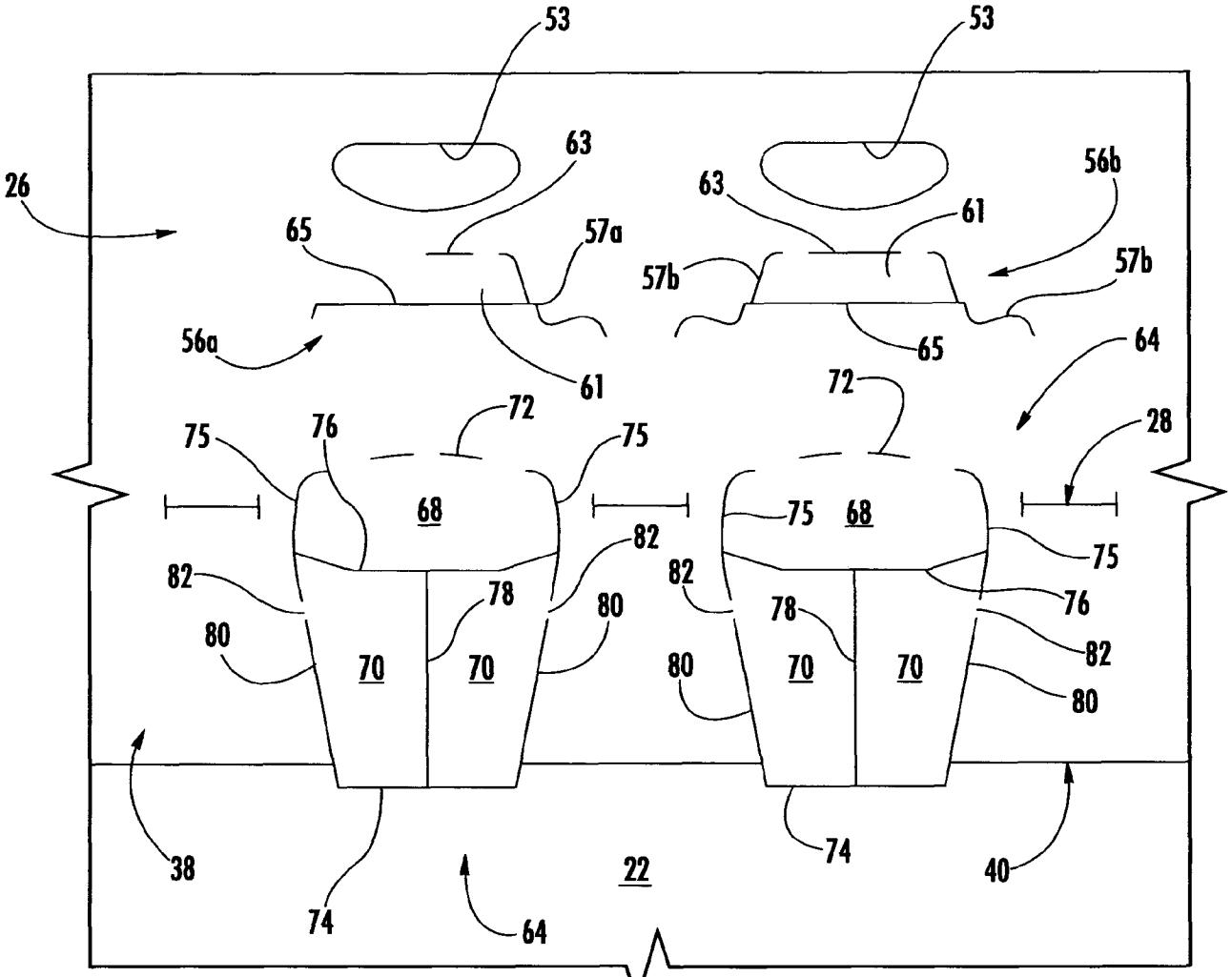
FIGS. 2A, 2B, and 3 are plan views of respective portions of the blank of FIG. 1.

In the illustrated embodiment, the side cuts 57*a*, 57*b* of the respective asymmetric slits 56*a* and symmetric slits 56*b* can be curved and can at least partially define a respective locking flap 61 (FIG. 2A). As shown in FIGS. 1 and 2A, each of the locking flaps 61 can be foldably connected to the first bottom panel 26 along a respective longitudinal fold line 63 and can be at least partially separable from the first bottom panel 26 along a respective longitudinal cut 65. Accordingly, the locking flaps 61 can be folded inwardly with respect to the first bottom panel 26 and engage the respective secondary locking tabs 58*a*, 58*b* when the secondary locking tabs are received in the respective slits 56*a*, 56*b*.

Figure 2B:
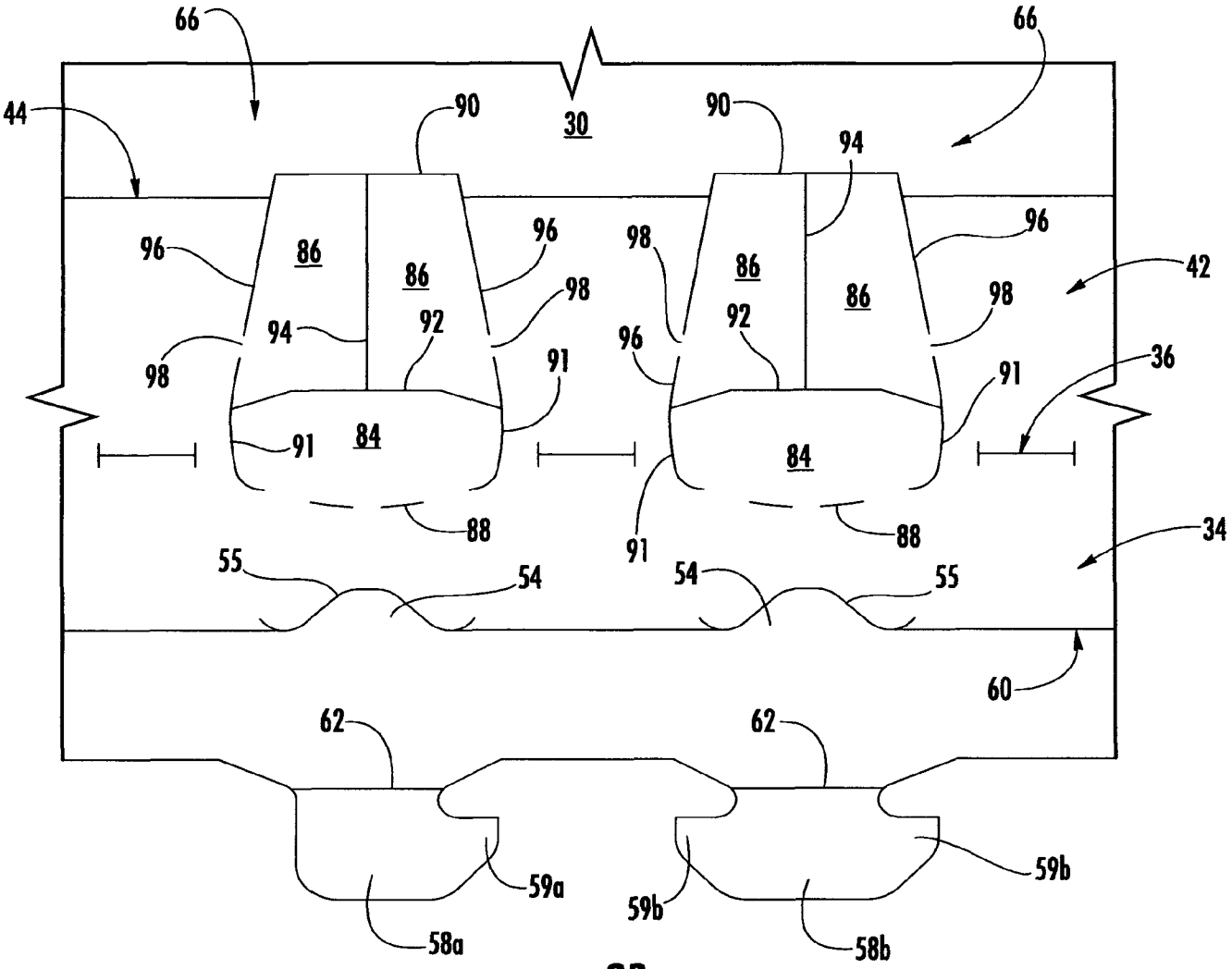

In one embodiment, the second bottom panel 34, which is the outer bottom panel in the completed carton 5, includes a longitudinal fold line 60, which is interrupted by slits 55 that at least partially define the primary male locking tab projections 54 (FIG. 2B). In addition, each of the secondary locking tab projections 58*a*, 58*b* can include a longitudinal fold line 62. Although the locking elements of the blank 3 are illustrated to demonstrate a particular bottom panel locking arrangement suitable for use with the carton 5, it is understood that any alternative form of bottom panel locking structure may be employed without departing from the disclosure. For example, all of the slits 56*a*, 56*b* and/or all of the secondary locking projections 58*a*, 58*b* can be symmetric or asymmetric.

As shown in FIGS. 1-2B, the bottom retention features 9 can include a row of first retention features 64 extending in the first bottom corner panel 38 and a row of second retention features 66 extending in the second bottom corner panel 42. As shown in FIG. 2A, each of the first retention features 64 includes a retention tab 68 adjacent to two corner flaps 70. In the illustrated embodiment, the retention tab 68 in each of the first retention features 64 can be foldably connected to the first bottom panel 26 along a fold line 72 (e.g., an arcuate fold line) and the corner flaps 70 in each of the first retention features 64 can be foldably connected to the first side panel 22 along a fold line 74. In one embodiment, the fold lines 72, 74 can be offset from the respective fold lines 28, 40 so that the retention tabs 68 interrupt the fold line 28 and the corner flaps 70 interrupt the fold line 40. Alternatively, the fold lines 72, 74 could be collinear with the respective fold lines 28, 40, or could be otherwise configured. As shown in FIGS. 1 and 2A, each of the retention tabs 68 is separable from the first bottom panel 26 and the first bottom corner panel 38 along curved cut lines 75 and is separable from the adjacent corner flaps 70 along a cut line 76. The corner flaps 70 of each of the first retention features 64 are separable from one another along a cut line 78. In an alternative embodiment, the cut lines 76, 78 could be replaced by tear lines, openings, or other suitable features. As shown in FIG. 2A, the corner flaps 70 are separable from the first side panel 22 and the first bottom corner panel 38 along respective cut lines 80 and are connected to the first bottom corner panel 38 at a respective nick 82, which interrupts the respective cut line 80. In an alternative embodiment, the corner flaps 70 could be otherwise foldably connected and/or separable from the first bottom corner panel 38 (e.g., along a fold line, a tear line, or other suitable feature).

As shown in FIG. 2B, each of the second retention features 66 includes a retention tab 84 adjacent to two corner flaps 86. In the illustrated embodiment, the retention tab 84 in each of the second retention features 66 can be foldably connected to the second bottom panel 34 along a fold line 88 and the corner flaps 86 in each of the second retention features 66 can be foldably connected to the second side panel 30 along a fold line 90. In one embodiment, the fold lines 88, 90 can be offset from the respective fold lines 36, 44 so that the retention tabs 84 interrupt the fold line 36 and the corner flaps 86 interrupt the fold line 44. Alternatively, the fold lines 88, 90 could be collinear with the respective fold lines 36, 44, or could be otherwise configured. As shown in FIGS. 1 and 2B, each of the retention tabs 84 is separable from the second bottom panel 34 and the second bottom corner panel 42 along curved cut lines 91 and is separable from the adjacent corner flaps 86 along a cut line 92. The corner flaps 86 of each of the second retention features 66 are separable from one another along a cut line 94. In an alternative embodiment, the cut lines 92, 94 could be replaced by tear lines, openings, or other suitable features. As shown in FIG. 2B, the corner flaps 86 are separable from the second side panel 30 and the second bottom corner panel 42 along respective cut lines 96 and are connected to the second bottom corner panel 42 at a respective nick 98, which interrupts the respective cut line 96. In an alternative embodiment, the corner flaps 86 could be otherwise foldably connected and/or separable from the second bottom corner panel 42 (e.g., along a fold line, a tear line, or other suitable feature).

In the illustrated embodiment, each of the retention tabs 68, 84 is positioned to engage at least a portion of a recess R at the bottom B of a respective container C (FIGS. 4-7). One or more of the first bottom corner features 64 and/or the second bottom corner features 66 could be omitted or could be otherwise shaped, arranged, positioned, and/or configured without departing from the disclosure.

Figure 3:
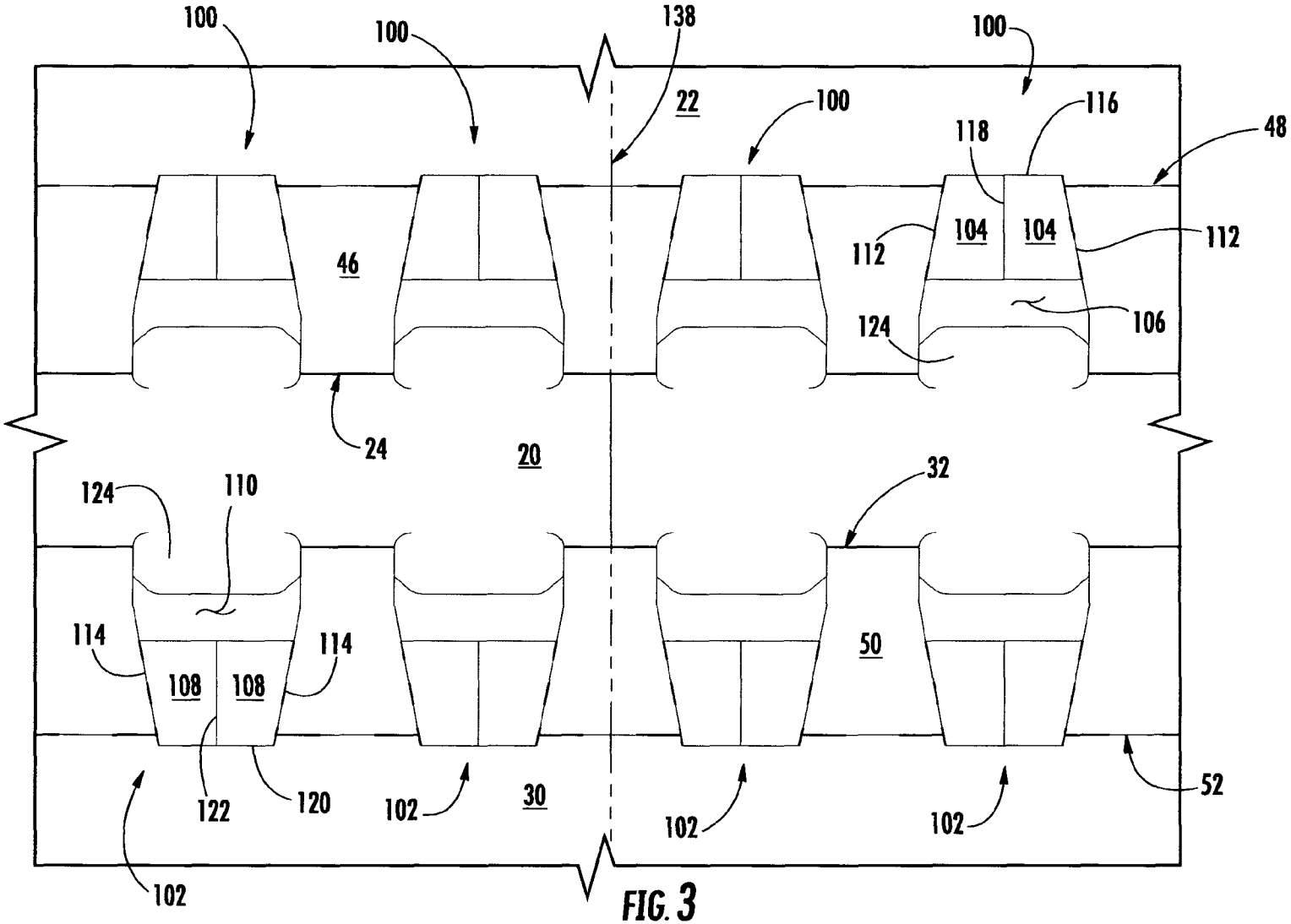

As shown in FIGS. 1 and 3, the top retention features 11 include a row of retention features 100 in the first top corner panel 46 and a row of retention features 102 in the second top corner panel 50. Each of the retention features 100 can include two corner flaps 104 adjacent an opening 106, and each of the retention features 102 can include two corner flaps 108 adjacent an opening 110. The corner flaps 104 can be foldably connected to the first top corner panel 46 along respective fold lines 112, and the corner flaps 108 can be foldably connected to the second top corner panel 50 along respective fold lines 114. In the illustrated embodiment, the corner flaps 104 can be separable from the first side panel 22 along a cut line 116 and from one another along a cut line 118, and the corner flaps 108 can be separable from the second side panel 30 along a cut line 120 and from one another along a cut line 122. In one embodiment, projections 124 can extend from the top panel 20 adjacent the openings 106, 110. As shown in FIGS. 1 and 3, the projections 124 can interrupt the fold lines 24, 32, the corner flaps 104 can interrupt the fold line 48, and the corner flaps 108 can interrupt the fold line 52. One or more of the retention features 100, 102 could be omitted or could be otherwise shaped, arranged, positioned, and/or configured without departing from the disclosure.

In one embodiment, the first side panel 22 is foldably connected to a first side end flap 126 and a second side end flap 128, and the second side panel 30 is foldably connected to a first side end flap 130 and a second side end flap 132. When the carton 5 is erected, the side end flaps 126, 130 close the first end 6 of the carton, and the side end flaps 128, 132 close the second end 8 of the carton. In accordance with an alternative embodiment of the present disclosure, different flap arrangements can be used for closing the ends 6, 8 of the carton.

As shown in FIG. 1, the end flaps 126, 130 extend along a first marginal area of the blank 3, and can be foldably connected at a first lateral fold line 134 that extends along the width of the blank. The end flaps 128, 132 extend along a second marginal area of the blank 3, and can be foldably connected at a second lateral fold line 136 that also extends along the width of the blank. The lateral fold lines 134, 136 may be, for example, substantially straight or offset at one or more locations to account for blank thickness or for other factors. The blank 3 could have other end flap arrangements without departing from the disclosure.

In the illustrated embodiment, the blank 3 can include a transverse tear line 138 extending along a centerline of the blank. Accordingly, the lateral tear line 138 can be actuated to separate the erected carton 5 into two portions. The tear line 138 could be omitted or could be otherwise positioned, shaped, and/or arranged without departing from the disclosure. For example, the tear line 138 could be offset from the centerline of the blank 3. In one alternative embodiment, the blank 3 could include dispenser features for accessing the containers C in the carton 5.

Figure 4:
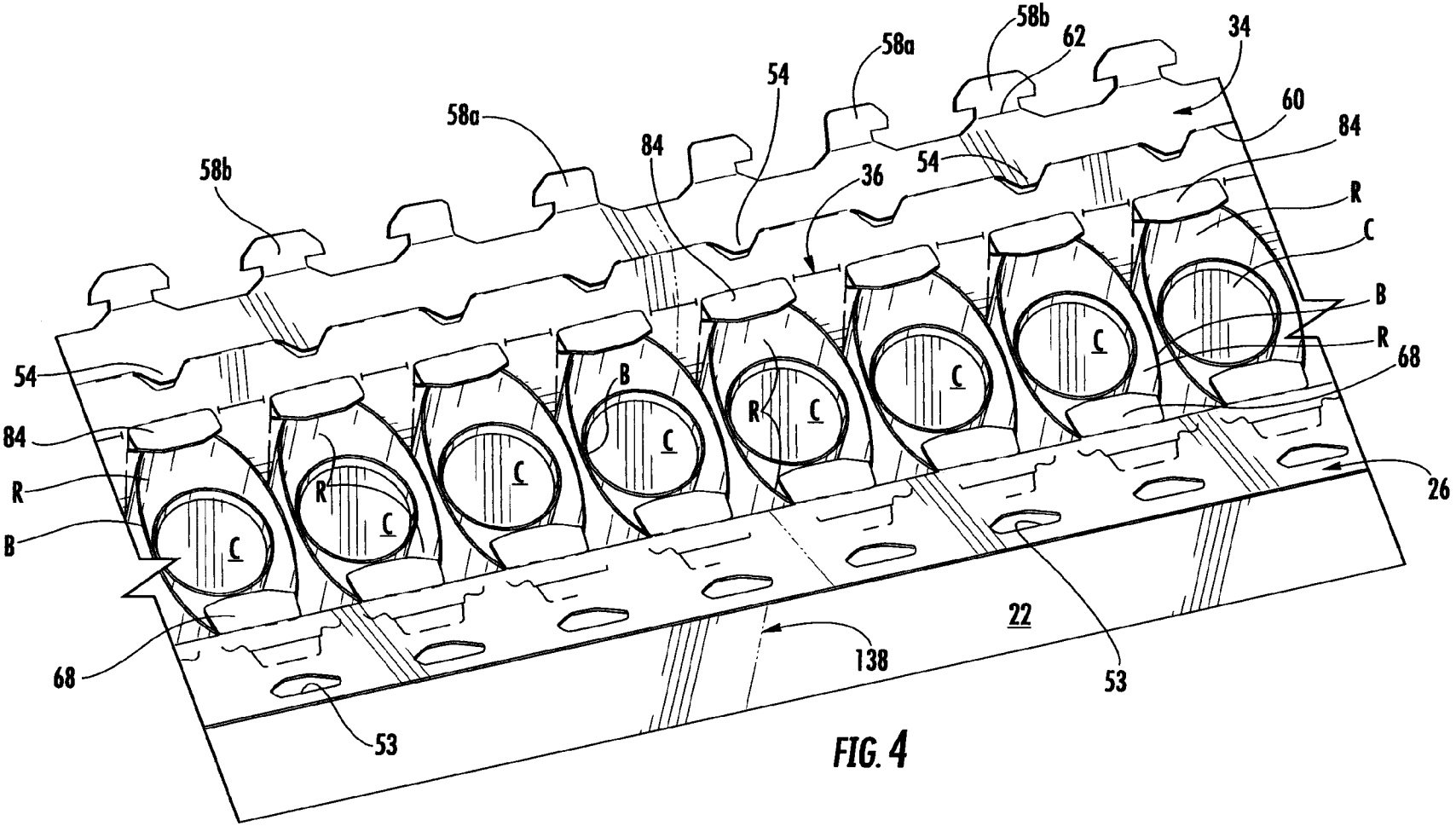
FIGS. 4-6 are perspective bottom views of a partially-assembled carton according to the exemplary embodiment showing the engagement of a plurality of retention tabs with a plurality of articles in the carton.

As shown in FIGS. 4-7, the carton 5 can be erected by wrapping the blank 3 around the containers C and interlocking the first and second bottom panels 26, 34 with the bottom retention features 9 actuated to engage the recess features R of the containers C. As shown in FIG. 4, the containers C are arranged in a row on the top panel 20 so that the tops (not shown) of the containers C are aligned with the top retention features 11. The side panels 22, 30 can be folded upwardly along respective fold lines 24, 32 so that the tops of the containers C contact the corner flaps 104, 108 and are received in the openings 106, 110 (not shown). As the side panels 22, 30 are folded, the bottom panels 26, 34 can be folded outwardly along the respective fold lines 28, 36. As shown in FIG. 4, the outwardly folding of the bottom panels can cause the retention tabs 68, 84 to separate from the respective bottom corner panels 38, 42, folding along respective fold lines 72, 88. Accordingly, the retention tabs 68, 84 can be aligned with the recesses R of the containers C when the side panels 22, 30 are brought into contact with the sides of the containers. In one embodiment, the retention tabs 68, 84 can separate from the respective corner panels 38, 42 during folding without being pushed by a tool, for example. Alternatively, the retention tabs could be forced to separate from the respective corner panels with a suitable tool, for example.

Figure 5:
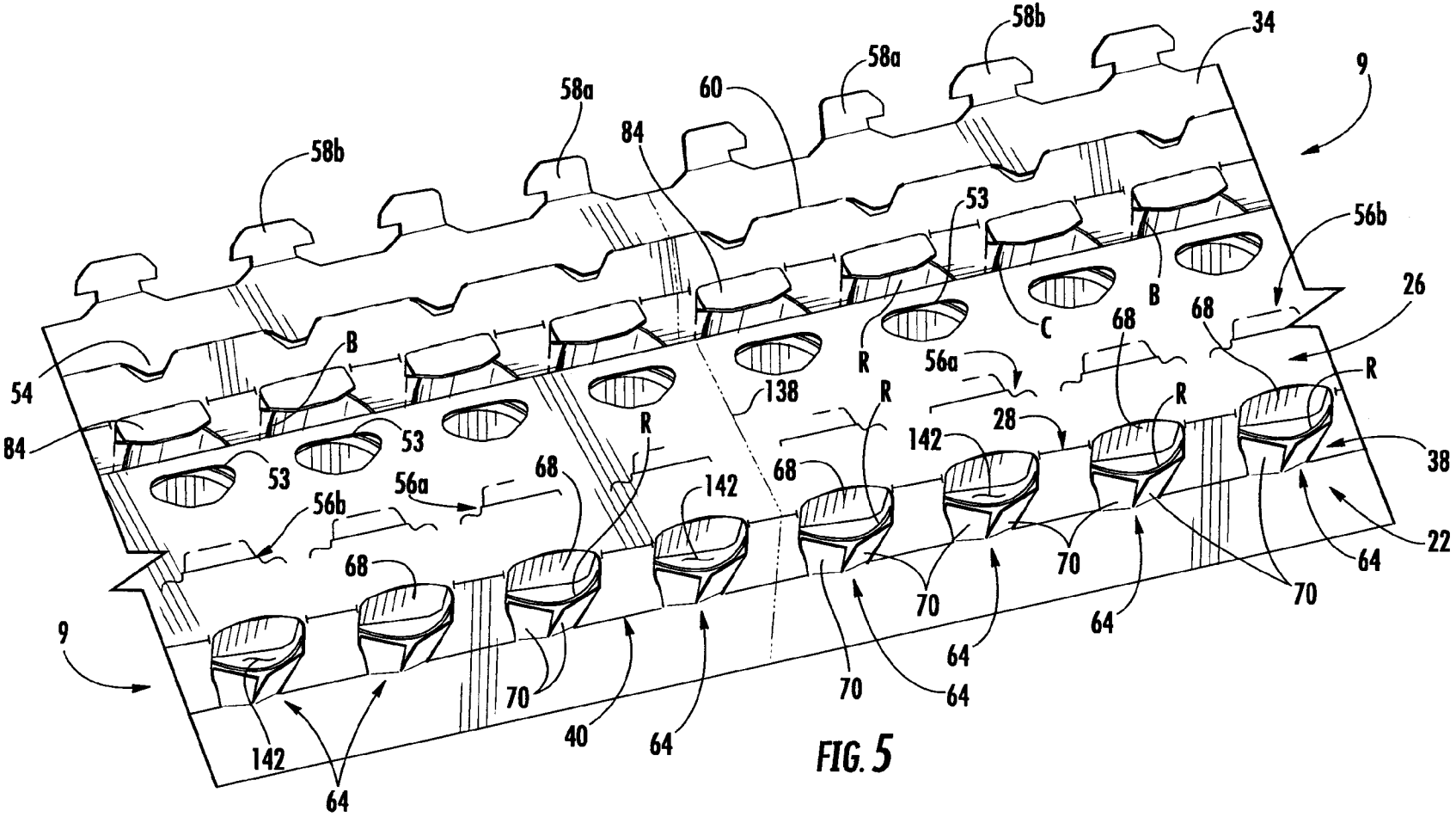
Figure 6:
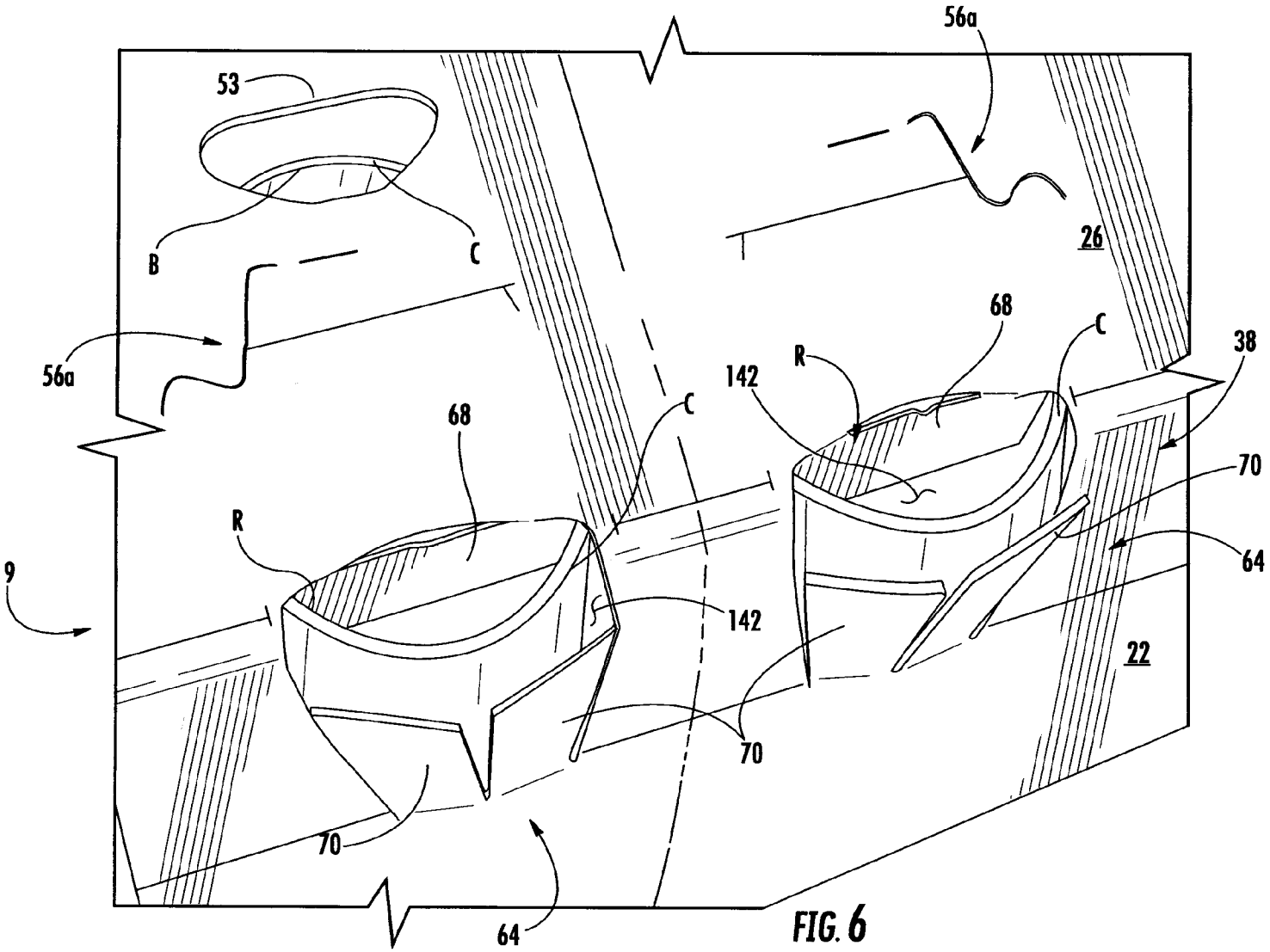

As shown in FIGS. 5 and 6, the first bottom panel 26 can be folded over the bottoms B of the containers C, and the retention tabs 68 can be pushed down into the respective recesses R of the respective containers. In one embodiment, the retention tabs 68 can rotate into the recesses R of the containers when the bottom panel 26 is folded over the bottom of the carton 5 along fold line 28. Alternatively, the retention tabs 68 can be forced into the recesses R by a suitable tool, for example. In the illustrated embodiment, the corner flaps 70 can be folded outwardly about fold lines 74 and at nicks 82 by contact with the bottoms B of the respective containers C. Accordingly, the bottoms B of the containers C can extend into respective openings 142 formed in the respective first retention features 64.

Figure 7:
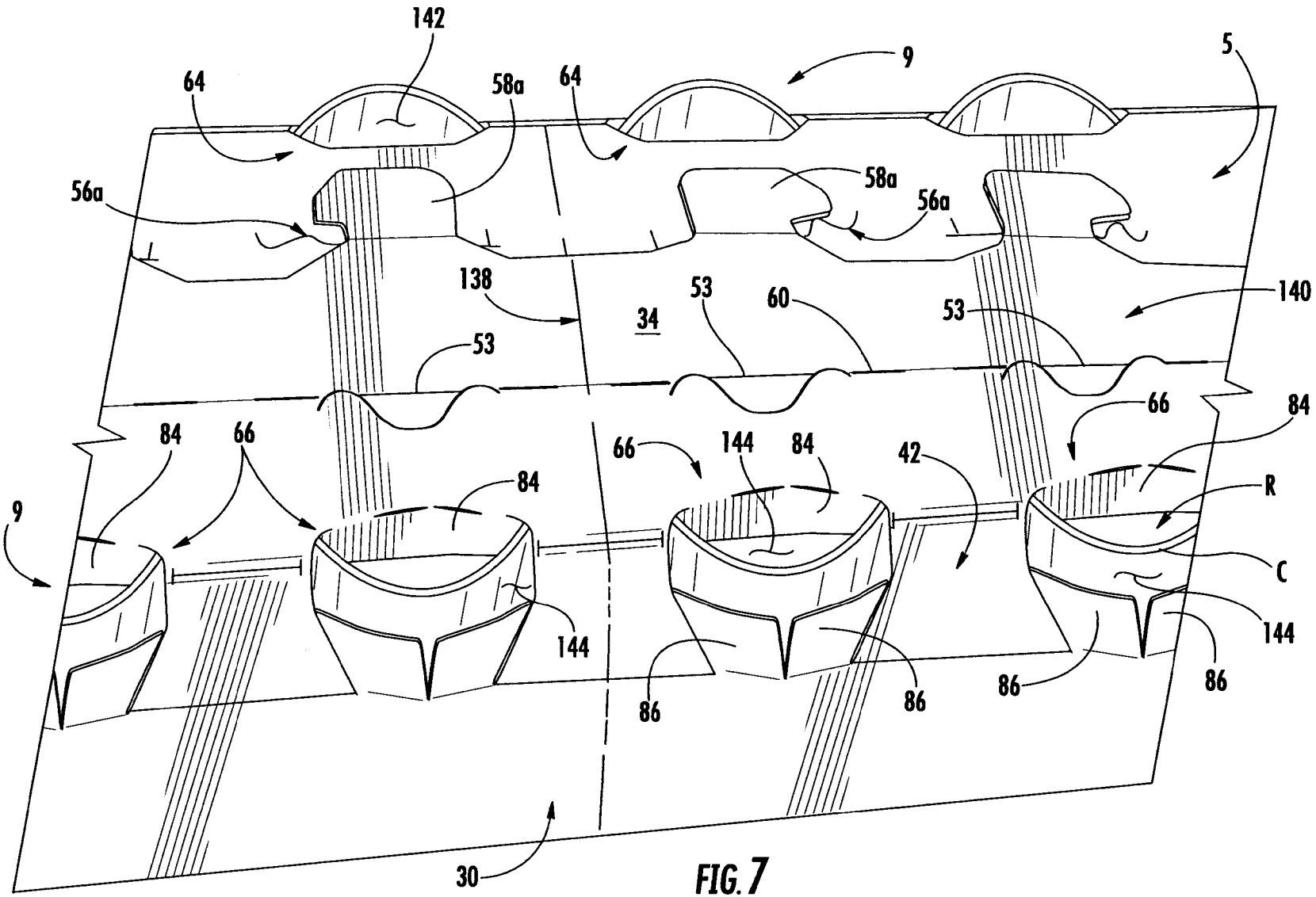
FIG. 7 is a perspective bottom view of the carton showing the bottom panels folded over the bottom of the carton according to the exemplary embodiment.

Similarly, as shown in FIG. 7, the second bottom panel 34 can be folded over the bottoms B of the containers C and the first bottom panel 26, and the retention tabs 84 can be pushed down into the respective recesses R of the respective containers. In one embodiment, the retention tabs 84 can rotate into the recesses R of the containers when the bottom panel 34 is folded over the bottom of the carton 5 along fold line 36. Alternatively, the retention tabs 84 can be forced into the recesses R by a suitable tool, for example. In the illustrated embodiment, the corner flaps 86 can be folded outwardly about fold lines 90 and at nicks 98 by contact with the bottoms B of the respective containers C. Accordingly, the bottoms B of the containers C can extend into respective openings 144 formed in the respective second retention features 66.

In one embodiment, the second bottom panel 34 is secured to the first bottom panel 26 by first respectively engaging primary male locking tabs 54 with the primary female locking edges 53. The primary male locking tabs 54 can be separated from the second bottom panel 34 by folding the second bottom panel along the fold line 60 so that the secondary male locking flaps **58*a*, 58*b* extend generally upwardly. Once the primary male locking flaps 54 are engaged with the female locking edges 53, the secondary male locking flaps 58*a*, 58*b* are respectively inserted through, and cooperatively interact with, the respective slits 56*a*, 56*b* to further secure the second bottom panel 34 to the first bottom panel 26. The interlocked bottom panels 26, 34 cooperate to form a bottom panel 140 of the carrier 5**.

The ends 6, 8 of the carton 5 can be closed (not shown) by overlapping the end flaps 126, 130 at the first end 6 and adhering the end flap 130 to the end flap 126 (e.g., at glue lines, glue tabs, or other suitable features), and by overlapping the end flaps 128, 132 at the second end 8 and adhering the end flap 132 to the end flap 128 (e.g., at glue lines, glue tabs, or other suitable features). The carton 5 could be formed with alternative forming steps without departing form the disclosure.

In the illustrated embodiment, the engagement of the folded retention tabs 68, 84 with the recesses R of the containers C can help prevent movement of the containers C within the carton 5 and can help prevent the containers C from being forced out of the carton 5. In addition, or alternatively, the engagement of the folded retention tabs 68, 84 with the recesses R of the containers C can help reduce damage to the carton 5 due to outside forced on the carton. The carton 5 could be otherwise shaped, arranged, positioned, and/or configured without departing from the disclosure.

In general, the blanks according to the present disclosure can be constructed from paperboard having a caliper so that it is heavier and more rigid than ordinary paper. The blanks can also be constructed of other materials, such as cardboard, or any other material having properties suitable for enabling the carton to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for carrying a plurality of articles, the carton comprising a plurality of panels at least partially extending around an interior of the carton, the plurality of panels comprising a top panel, a side panel, and a bottom panel;

at least one retention tab foldably connected to the bottom panel, the at least one retention tab being for engaging at least a portion of an article of the plurality of articles; and at least one corner flap foldably connected to the side panel, wherein each of the at least one retention tab and the at least one corner flap is disposed adjacent to at least one corner opening in the carton;

wherein the at least one retention tab is folded inwardly with respect to the bottom panel and the at least one corner flap is folded outwardly with respect to the side panel so that the at least one retention tab is spaced apart from the at least one corner flap.

2. The carton of claim 1, wherein the at least one corner flap comprises a first corner flap and a second corner flap each foldably connected to the side panel along a respective fold line adjacent the at least one corner opening.

3. The carton of claim 2, wherein the first corner flap and the second corner flap are separable from one another along a first cut line, and each of the first corner flap and the second corner flap is separable from the side panel along a respective second cut line and third cut line.

4. The carton of claim 1, wherein the at least one retention tab is foldably connected to the bottom panel along an arcuate fold line at a bottom end of the at least one corner opening, and the at least one corner flap is foldably connected to the side panel along a fold line at an opposing end of the at least one corner opening.

5. The carton of claim 1, wherein the side panel is foldably connected to the bottom panel along a first fold line, a second fold line extends in the side panel, and the side panel comprises a bottom corner panel extending between the first fold line and the second fold line.

6. The carton of claim 5, wherein the at least one corner opening extends at least partially in the bottom corner panel.

7. The carton of claim 1, wherein the at least one retention tab is folded generally upwardly from the bottom panel to engage a recess of the article and the at least one corner flap is for engaging an exterior side of the article at least partially received in the at least one corner opening.

8. The carton of claim 1, wherein the at least one retention tab and the at least one corner flap are generally aligned with at least one locking feature in the bottom panel.

9. The carton of claim 1, wherein the side panel comprises a first side panel and the plurality of panels further comprises a second side panel, the bottom panel comprises a first bottom panel foldably connected to the first side panel and the plurality of panels further comprises a second bottom panel foldably connected to the second side panel, the at least one retention tab comprises at least one first retention tab foldably connected to the first bottom panel and at least one second retention tab foldably connected to the second bottom panel, and the at least one corner flap comprises at least one first corner flap foldably connected to the first side panel and at least one second corner flap foldably connected to the second side panel.

10. The carton of claim 9, wherein the at least one corner opening comprises at least one first corner opening and at least one second corner opening each for at least partially receiving a portion of the article.

11. The carton of claim 10, wherein the at least one first retention tab and the at least one first corner flap are adjacent the at least one first corner opening, and the at least one second retention tab and the at least one second corner flap are adjacent the at least one second corner opening.

12. The carton of claim 9, wherein the first bottom panel and the second bottom panel are foldably connected to the respective first side panel and second side panel along respective longitudinal fold lines, at least one first bottom locking feature is disposed in the first bottom panel, at least one second bottom locking feature is disposed in the second bottom panel, and the at least one first retention tab, the at least one first bottom locking feature, the at least one second retention tab, and the at least one second bottom locking feature are generally aligned along a lateral direction.

13. The carton of claim 1, further comprising at least two top corner flaps foldably connected to the side panel adjacent a top corner opening for at least partially receiving a top portion of the article, the top corner opening being adjacent the top panel.

14. The carton of claim 13, wherein the bottom panel is foldably connected to the side panel along a first longitudinal fold line, the side panel is foldably connected to the at top panel along a second longitudinal fold line, and the at least one retention tab, the at least one corner opening, and the at least one top corner opening are generally aligned in a lateral direction.

15. The carton of claim 1, further comprising an end flap foldably connected to the side panel for at least partially closing an end of the carton.

16. A carton for carrying a plurality of articles, the carton comprising a plurality of panels at least partially extending around an interior of the carton, the plurality of panels comprising a top panel, a side panel, and a bottom panel, wherein the side panel is foldably connected to the bottom panel along a first fold line, a second fold line extends in the side panel, and the side panel comprises a bottom corner panel extending between the first fold line and the second fold line;

at least one retention tab foldably connected to the bottom panel, the at least one retention tab being for engaging at least a portion of an article of the plurality of articles; and at least one corner flap foldably connected to the side panel, wherein each of the at least one retention tab and the at least one corner flap is disposed adjacent to at least one corner opening in the carton;

wherein the at least one retention tab is foldably connected to the bottom panel along a third fold line, the at least one corner flap is foldably connected to the side panel along a fourth fold line, and at least a portion of each of the third fold line and the fourth fold line is spaced apart from each of the first fold line and the second fold line.

17. A blank for forming a carton for holding a plurality of articles, the blank comprising:

a plurality of panels comprising a top panel, a side panel, and a bottom panel;

at least one retention tab foldably connected to the bottom panel; and at least one corner flap foldably connected to the side panel, the at least one retention tab being at least partially separable from the at least one corner flap along at least one first cut line for forming at least one corner opening in the carton formed from the blank, wherein the at least one corner flap is at least partially separable from the side panel along at least one second cut line.

18. The blank of claim 17, wherein the at least one corner flap comprises a first corner flap and a second corner flap each foldably connected to the side panel along a respective fold line.

19. The blank of claim 18, wherein the first corner flap and the second corner flap are separable from one another along a third cut line, and each of the first corner flap and the second corner flap is separable from the side panel along a respective fourth cut line and fifth cut line.

20. The blank of claim 17, wherein the at least one retention tab is foldably connected to the bottom panel along an arcuate fold line at a bottom end of the at least one corner opening when the carton is formed from the blank, and the at least one corner flap is foldably connected to the side panel along a fold line at an opposing end of the at least one corner opening when the carton is formed from the blank.

21. The blank of claim 17, wherein the side panel is foldably connected to the bottom panel along a first fold line, a second fold line extends in the side panel, and the side panel comprises a bottom corner panel extending between the first fold line and the second fold line.

22. The blank of claim 21, wherein the at least one corner flap extends at least partially in the bottom corner panel.

23. The blank of claim 17, wherein the at least one retention tab and the at least one corner flap are generally aligned with at least one locking feature in the bottom panel.

24. The blank of claim 17, wherein the side panel comprises a first side panel and the plurality of panels further comprises a second side panel, the bottom panel comprises a first bottom panel foldably connected to the first side panel and the plurality of panels further comprises a second bottom panel foldably connected to the second side panel, the at least one retention tab comprises at least one first retention tab foldably connected to the first bottom panel and at least one second retention tab foldably connected to the second bottom panel, and the at least one corner flap comprises at least one first corner flap foldably connected to the first side panel and at least one second corner flap foldably connected to the second side panel.

25. The blank of claim 24, wherein the first bottom panel and the second bottom panel are foldably connected to the respective first side panel and second side panel along respective longitudinal fold lines, at least one first bottom locking feature is disposed in the first bottom panel, at least one second bottom locking feature is disposed in the second bottom panel, and the at least one first retention tab, the at least one first bottom locking feature, the at least one second retention tab, and the at least one second bottom locking feature are generally aligned along a lateral direction.

26. The blank of claim 17, further comprising at least two top corner flaps foldably connected to the side panel adjacent a top corner opening for at least partially receiving a top portion of the article, the top corner opening being adjacent the top panel.

27. The blank of claim 26, wherein the bottom panel is foldably connected to the side panel along a first longitudinal fold line, the panel is foldably connected to the at top panel along a second longitudinal fold line, and the at least one retention tab and the at least one top corner opening are generally aligned in a lateral direction.

28. The blank of claim 17, further comprising an end flap foldably connected to the side panel for at least partially closing an end of the carton formed from the blank.

29. A blank for forming a carton for holding a plurality of articles, the blank comprising:

a plurality of panels comprising a top panel, a side panel, and a bottom panel, wherein the side panel is foldably connected to the bottom panel along a first fold line, a second fold line extends in the side panel, the side panel comprises a bottom corner panel extending between the first fold line and the second fold line;

at least one retention tab foldably connected to the bottom panel; and at least one corner flap foldably connected to the side panel, the at least one retention tab being at least partially separable from the at least one corner flap along at least one cut line for forming at least one corner opening in the carton formed from the blank;

wherein the at least one retention tab is foldably connected to the bottom panel along a third fold line, the at least one corner flap is foldably connected to the side panel along a fourth fold line, and at least a portion of each of the third fold line and the fourth fold line is spaced apart from each of the first fold line and the second fold line.

30. A method of forming a carton for holding a plurality of articles, comprising:

obtaining a blank comprising a plurality of panels comprising a top panel, a side panel, and a bottom panel, at least one retention tab foldably connected to the bottom panel, and at least one corner flap foldably connected to the side panel, the at least one retention tab being at least partially separable from the at least one corner flap along at least one cut line;

forming an interior of the carton at least partially defined by the plurality of panels, the forming the interior comprising folding the bottom panel with respect to the side panel; and at least partially engaging the at least one retention tab with a bottom portion of an article of the plurality of articles, the engaging the at least one retention tab at least partially forming a corner opening in the carton, wherein the engaging the at least one retention tab comprises folding the at least one retention tab inwardly with respect to the bottom panel and folding the at least one corner flap outwardly with respect to the side panel so that the at least one corner flap is spaced apart from the at least one retention tab.

31. The method of claim 30, wherein the forming the interior of the carton comprises folding the bottom panel outwardly with respect to the side panel prior to the engaging the at least one retention tab and folding the bottom panel inwardly with respect to the side panel after the engaging the at least one retention tab.

32. The method of claim 31, wherein the folding the bottom panel outwardly at least partially separates the at least one retention tab from the at least one corner flap, and the folding the bottom panel inwardly at least partially inserts the at least one retention tab into a recess in the bottom portion of the article.

33. The method of claim 30, wherein:

the side panel comprises a first side panel and the plurality of panels further comprises a second side panel, the at least one bottom panel comprises a first bottom panel foldably connected to the first side panel the plurality of panels further comprises a second bottom panel foldably connected to the second side panel, and the at least one retention tab comprises at least one first retention tab foldably connected to the first bottom panel and at least one second retention tab foldably connected to the second bottom panel; and the forming the interior of the carton comprises folding the first bottom panel and the second bottom panel outwardly with respect to the respective first side panel and second side panel prior to the engaging the at least one retention tab, folding the first bottom panel inwardly with respect to the first side panel after the engaging the at least one retention tab, and then folding the second bottom panel inwardly with respect to the second side panel after the engaging the at least one retention tab.

34. The method of claim 33, wherein the folding the first bottom panel and the second bottom panel outwardly at least partially separates the at least one first retention tab and the at least one second retention tab from the respective first bottom panel and second bottom panel, the folding the first bottom panel inwardly at least partially inserts the at least one first retention tab into a recess in the bottom portion of the article, and the folding the second bottom panel inwardly at least partially inserts the at least one second retention tab into the recess in the bottom portion of the article.

* * * * *